US006739250B2

(12) United States Patent
Kitagawa

(10) Patent No.: US 6,739,250 B2
(45) Date of Patent: May 25, 2004

(54) DEVICE FOR CONTROLLING ROTATION OF ROTATING DRUM

(75) Inventor: Tomoya Kitagawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/388,391

(22) Filed: Mar. 17, 2003

(65) Prior Publication Data

US 2003/0177921 A1 Sep. 25, 2003

(30) Foreign Application Priority Data

Mar. 20, 2002 (JP) ..... 2002-078733

(51) Int. Cl.[7] ..... B41F 5/00
(52) U.S. Cl. ..... 101/216; 101/477; 101/415.1
(58) Field of Search ..... 101/477, 216, 101/415.1

(56) References Cited

U.S. PATENT DOCUMENTS 4,603,641 A * 8/1986 Jeschke et al. ..... 101/415.1
4,785,733 A * 11/1988 Hartung et al. ..... 101/181
5,178,070 A * 1/1993 Zorn et al. ..... 101/486
5,394,614 A * 3/1995 Lindner et al. ..... 33/621
5,479,859 A * 1/1996 Lindner et al. ..... 101/485
5,713,287 A 2/1998 Gelbart
6,343,549 B1 * 2/2002 Tokiwa ..... 101/248
6,360,664 B1 * 3/2002 Gottling et al. ..... 101/481
6,463,854 B1 * 10/2002 Rautert et al. ..... 101/481
6,510,793 B1 * 1/2003 Kerr et al. ..... 101/382.1
6,520,700 B1 * 2/2003 Iwata ..... 400/582
6,571,708 B1 * 6/2003 Rudzewitz et al. ..... 101/477
6,591,184 B2 * 7/2003 Yonezawa et al. ..... 701/113

FOREIGN PATENT DOCUMENTS

DE 4223908 A1 * 1/1994 ..... B41F/13/16
EP 551976 A1 * 7/1993 ..... B41F/27/00

* cited by examiner

*Primary Examiner*—Andrew H. Hirshfeld
*Assistant Examiner*—Andrea H. Evans
(74) *Attorney, Agent, or Firm*—Taiyo, Nakajima & Kato

(57) ABSTRACT

As a rotational reference position of a rotating drum is detected by a rotational position detection sensor for each rotation of the rotating drum, a rotational position of the rotating drum at a time of detection can be known. Subsequent to a signal for instructing stop of the rotating drum being input, the rotational reference position is detected. Then, a stop position calculation processing section calculates a stop control pulse for stopping the rotating drum from the rotational position at a trailing edge chuck detaching position. Thus, the rotating drum is reliably stopped at the trailing edge chuck detaching position. A stop processing is performed by a rotating drum drive control section when the rotational reference position is detected after the calculation. As a result, the stop position is not shifted by the time required for calculation and generation of the stop control pulse.

12 Claims, 10 Drawing Sheets

DEVICE FOR CONTROLLING ROTATION OF ROTATING DRUM

BACKGROUND OF THE INVENTION

1. Field of the Invention

The present invention relates to a device for controlling rotation of rotating drum.

2. Description of the Related Art

There has been developed a technique in which while a rotating drum is rotated with a sheet of recording material, in particular a printing plate with a photosensitive layer on its substrate being rolled around a peripheral surface of the rotating drum (main scanning) a recording head is moved in an axial direction of the rotating drum (sub-scanning), so that an image is directly recorded onto the photosensitive layer (an emulsion surface) of the printing plate by laser beams (exposure device for printing plate). Such technique enables rapid image recording onto a printing plate.

The printing plate generally includes, in addition to the concept of a printing plate which is subjected to image recording in advance, then rolled around a plate cylinder, the concept of printing materials that image recording is performed directly on a rotating drum (including an elongated photosensitive film successively rolled around a rotating drum, a photosensitive film layer that its coating and removal are repeated, an engraving plate and the like).

According to this type of image recording device, end portions of a printing plate in a direction the printing plate is rolled around are held by a leading edge chuck and a trailing edge chuck. A position of the trailing edge chuck may be varied depending on the length of the printing plate in a direction the plate is rolled around. For this reason, a relative position of the trailing edge chuck with a rotating drum is set on the basis of information about the size of the printing plate obtained in advance.

When a rotating drum is stopped after image recording, a trailing edge chuck holding a printing plate is firstly released. Then, the rotating drum is rotated in reverse in order to successively output a printing plate rolled around the peripheral surface of the rotating drum to a discharge tray. Subsequently, a leading edge chuck is released and the printing plate is discharged outside an image recording device.

Control for stopping a rotating drum after image recording is such that a trailing edge of a printing plate rolled around the rotating drum is positioned at a trailing edge chuck releasing position in a vicinity of a discharge tray.

Thus, a sensor for detecting a rotational position of a rotating drum is provided. An amount of rotational movement (the number of pulses) since stop is instructed for the rotating drum is calculated on the basis of rotational position information from the sensor and positional information of trailing edge of printing plate. Then, the rotating drum is stopped on the basis of the result of calculation.

According to a conventional device for controlling rotation of rotating drum, however, because the rotating drum is rotating while the calculation, the position that the rotating drum is stopped is shifted by the time required for calculation. Consequently, the rotating drum cannot be stopped precisely at a trailing edge chuck releasing position.

Thus, the position that the rotating drum is stopped must be corrected during a decrease in rotational speed of the rotating drum or after the rotating drum is stopped, resulting in complicated control of the rotating drum.

SUMMARY OF THE INVENTION

The present invention is developed in light of the above-described facts, and an object of the invention is to obtain a device for controlling rotation of rotating drum that is capable of stopping precisely and rapidly a rotating drum at a predetermined position.

A first aspect of the invention provides a device for controlling rotation of rotating drum for image recording that is used for an image recording device in which a recording head is moved in an axial direction of the rotating drum so as to record an image onto the rotating drum rotating with a sheet of recording material being rolled around its peripheral surface and that controls a rotational operation of the rotating drum, comprising: rotational position detection unit for detecting a rotational position of the rotating drum at least for each rotation thereof; stop control pulse generation unit for detecting a first rotational position of the rotating drum after a stop signal for instructing stop of rotation of the rotating drum is input, and for calculating a stop control pulse on the basis of the first rotational position and generating the same; correction unit for detecting a second rotational position of the rotating drum after generation of the stop control pulse and for correcting the stop control pulse on the basis of a positional deviation with respect to the first rotational position detected when the stop control pulse started to be generated; and control unit for controlling stop of the drum on the basis of the corrected stop control pulse corrected by the correction unit.

According to the first aspect, the rotational position detection unit detects a rotational position of the rotating drum at least for each rotation thereof, and thus a rotational position of the rotating drum when detected can be known. Subsequent to a stop signal for instructing stop of rotation of the rotating drum being input, a first rotational position of the rotating drum is detected. The stop control pulse generation unit calculates a stop control pulse on the basis of the first rotational position for stopping the rotating drum at a determined stop position and generates the same. Thus, the rotating drum can be reliably stopped at the determined stop position. Further, a second rotational position that a stop processing is performed is detected. The correction unit corrects the stop control pulse on the basis of a positional deviation between the first rotational position and the second rotational position. The control unit controls stop of the rotating drum on the basis of the corrected stop control pulse. As a result, the stop position is not shifted by the time required for calculation and generation of the stop control pulse.

It is possible to precisely and rapidly stop the rotating drum rotating at high speed at a predetermined position.

A second aspect of the invention provides a device for controlling rotation of rotating drum for image recording according to the first aspect, wherein it is set to output one pulse during rotation of the rotating drum for one time, subsequent to the stop signal being input, the rotational position detection unit detects a first rotational position, the stop control pulse generation unit starts to calculate and generate a stop control pulse, a second rotational position is detected after generation of the stop control pulse and then the rotating drum is stopped by the control unit, so that a correction by the correction unit is offset.

According to the second aspect, the rotational position detection unit of the first aspect outputs one pulse during rotation of the rotating drum for one time and detects a rotational position for each of rotation thereof. Subsequent to a stop signal being input, a first rotational position is detected. The stop control pulse generation unit begins to calculate a stop control pulse and generate the same. After the stop control pulse is generated, a second rotational position is detected. Then, the control unit stops the rotating drum. Thus, a difference in rotational angle needs not to be considered. Further, a correction by the correction unit can be offset. As a result, the rotating drum rotating at high speed can be precisely and rapidly stopped at a predetermined position.

A third aspect provides a device for controlling rotation of rotating drum for image recording according to the first or the second aspect, wherein the control unit starts to decrease a rotational speed of the rotating drum after the stop signal is input and before the stop control pulse generation unit starts to calculate, stops deacceleration of the rotating drum at a time when calculation and generation of the stop control pulse become possible during rotation of the rotating drum for one time and detects a first rotational position.

According to the third aspect, the control unit of the first or the second aspect decreases a rotational speed of the rotating drum to a rotational speed that enables calculation and generation of the stop control pulse during rotation of the rotating drum for one time after the stop signal is input and before the stop control pulse generation unit begins to calculate. Then, the rotational position detection unit detects a first rotational position. The rotational speed of the rotating drum is decreased immediately after the stop signal is input. Thus, the time from when the stop signal is input to when the rotating drum is stopped becomes shorter.

A fourth aspect provides a device for controlling rotation of rotating drum for image recording according to the first aspect, wherein the rotational position detection unit outputs a plurality of pulses during rotation of the rotating drum for one time and detects a first rotational position after the stop signal is input, the stop control pulse generation unit starts to calculate and generate the stop control pulse, the rotational position detection unit detects a second rotational position after generation of the stop control pulse, and the correction unit corrects the stop control pulse by a difference of rotational angle between the first detected position and the second detected position.

According to the fourth aspect, the rotational position detection unit according to the first aspect outputs a plurality of pulses during rotation of the rotating drum for one time and a rotational position of the rotating drum can be detected for a plurality of times during its rotation for one time. Thus, a rotational position can be immediately detected regardless of a rotational position of the rotating drum. After a stop signal is input, a first rotational position is detected. The stop control pulse generation unit begins to calculate a stop control pulse and generate the same. After the stop control pulse is generated, a second rotational position is detected. The correction unit corrects the stop control pulse by a difference in rotational angle between the first detected position and the second detected position. Consequently, a stop control pulse can be immediately corrected without a stop position being shifted by the time required for calculation and generation of the stop control pulse.

BRIEF DESCRIPTION OF THE DRAWINGS

FIG. 10 illustrates processes for image recording on a direct input type plate cylinder, wherein

DESCRIPTION OF THE PREFERRED EMBODIMENTS (First Embodiment)

Figure 1:
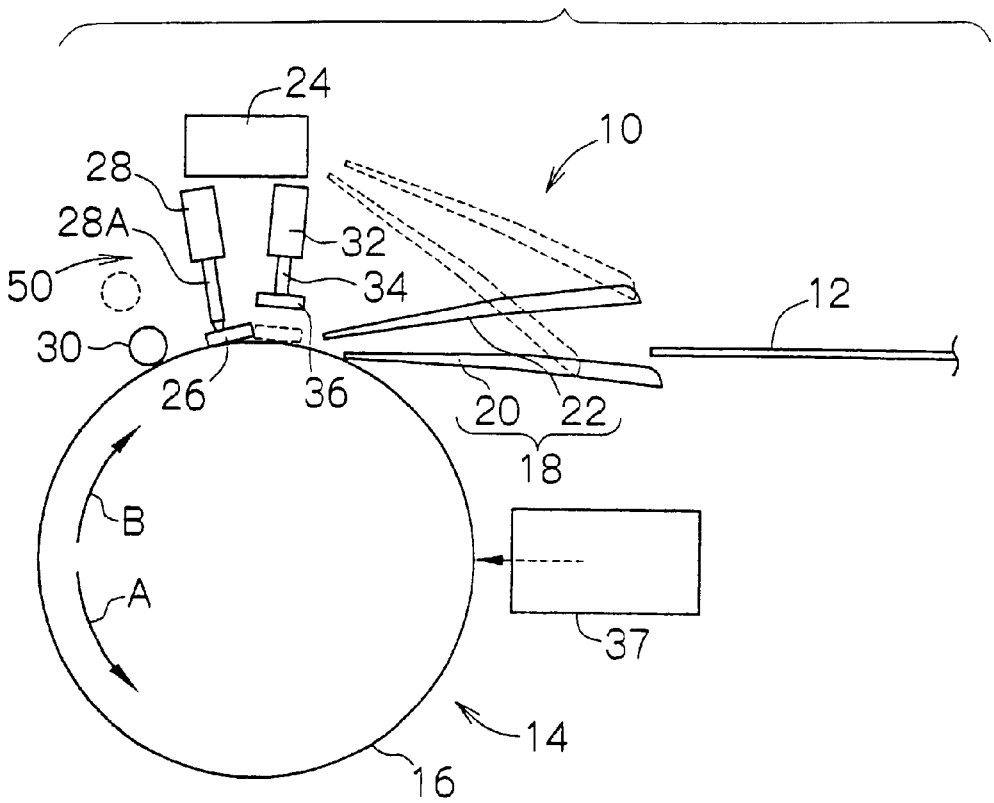
FIG. 1 is a schematic view of an automatic exposure device for printing plate according to the present embodiments.

FIG. 1 shows an exposure section 14 of an automatic exposure device for printing plate according to the present embodiment.

The exposure section 14 is structured so that a rotating drum 16 which holds a printing plate 12 rolled around its peripheral surface serves as a main portion. The printing plate 12 is guided by a conveyance guide unit 18 and fed into the rotating drum 16 from its tangential direction.

A puncher 24 for making a positioning notch at a leading edge of the printing plate 12 is disposed upward of the rotating drum 16 in FIG. 1.

The conveyance guide unit 18 is formed of a feed plate guide 20 and a discharge plate guide 22. The relative positional relationship between the feed plate guide 20 and the discharge plate guide 22 of the conveyance guide unit 18 is such that the feed plate guide 20 and the discharge plate guide 22 form a lying down V-shape configuration. The guides are pivoted about their right end portions in FIG. 1 by a predetermined angle. Because of such pivots, the feed plate guide 20 and the discharge plate guide 22 can selectively correspond to the rotating drum 16 or the puncher 24.

When a positioning notch is made at the printing plate 12 by the puncher 24, the printing plate 12 is temporarily returned to the feed plate guide 20. Then, the conveyance guide unit 18 is pivoted so as to correspond to the rotating drum 16.

The rotating drum 16 is rotated by an unillustrated driving unit in a direction that the printing plate 12 is attached and exposed (i.e., in a direction of the arrow A shown in FIG. 1) and in a direction that the printing plate 12 is removed which is opposite to the direction the printing plate 12 is attached and exposed (i.e., in a direction of the arrow B shown in FIG. 1).

A leading edge chuck 26 is mounted at a predetermined position on the peripheral surface of the rotating drum 16 provided in the exposure section 14. In the exposure section 14, at a time of attaching the printing plate 12 to the rotating drum 16, the rotating drum 16 stops at a position that the leading edge chuck 26 opposes the leading edge of the printing plate 12 fed by the feed plate guide 20 of the conveyance guide unit 18 (i.e., at a printing plate attaching position).

The exposure section 14 is provided with an attachment unit 28 so as to oppose the leading edge chuck 26 at the printing plate attaching position. An end of the leading edge chuck 26 is pressed by an extendable rod 28A of the attachment unit 28 being extended. Thus, the printing plate 12 can be inserted into between the peripheral surface of the rotating drum 16 and the leading edge chuck 26.

At the exposure section 14, while the leading edge of the printing plate 12 being inserted between the leading edge chuck 26 and the rotating drum 16, the extendable rod 28A of the attachment unit 28 is retracted and thus pressing of the leading edge chuck 26 is released. As a result, the leading edge of the printing plate 12 is nipped between the leading chuck 26 and the peripheral surface of the rotating drum 16 and held therebetween.

At this time, the leading edge of the printing plate 12 is abutted against a positioning pin (not shown) provided at the rotating drum 16 so as to be positioned.

In the exposure section 14, when the leading edge of the printing plate 12 is fixed to the rotating drum 16, the rotating drum 16 is rotated in a direction of attaching and exposing. Then, the printing plate 12 fed from the feed plate guide 20 of the conveyance guide unit 18 is rolled around the peripheral surface of the rotating drum 16.

A squeeze roller 30 is disposed in a vicinity of the peripheral surface of the rotating drum 16 in the downstream side of the printing plate attaching position in the direction of attaching and exposing. By the squeeze roller 30 being moved toward the rotating drum 16, the roller presses the printing plate 12 rolled around the rotating drum 16 toward the same and fits the printing plate 12 and the peripheral surface of the rotating drum 16 close together.

At the exposure section 14, a trailing edge chuck detachment unit 32 is disposed in the upstream of the squeeze roller 30 (further upstream of the leading edge chuck 26) in the direction of attaching and exposing of the rotating drum 16. A shaft 34 protruding toward the rotating drum 16 is mounted to the trailing edge chuck detachment unit 32. A trailing edge chuck 36 is attached to the distal end of the shaft 34.

At the exposure section 14, when the trailing edge of the printing plate 12 rolled around the rotating drum 16 opposes the trailing edge chuck detachment unit 32, the shaft 34 is protruded so as to attach the trailing edge chuck 36 to a predetermined position on the rotating drum 16. In this way, the trailing edge of the printing plate varying for each printing plate can be nipped and held between the trailing edge chuck 36 and the rotating drum 16.

When the leading edge and the trailing edge of the printing plate 12 are held by the rotating drum 16 in the exposure section 14, the squeeze roller 30 is moved away from the rotating drum 16.

Figure 2:
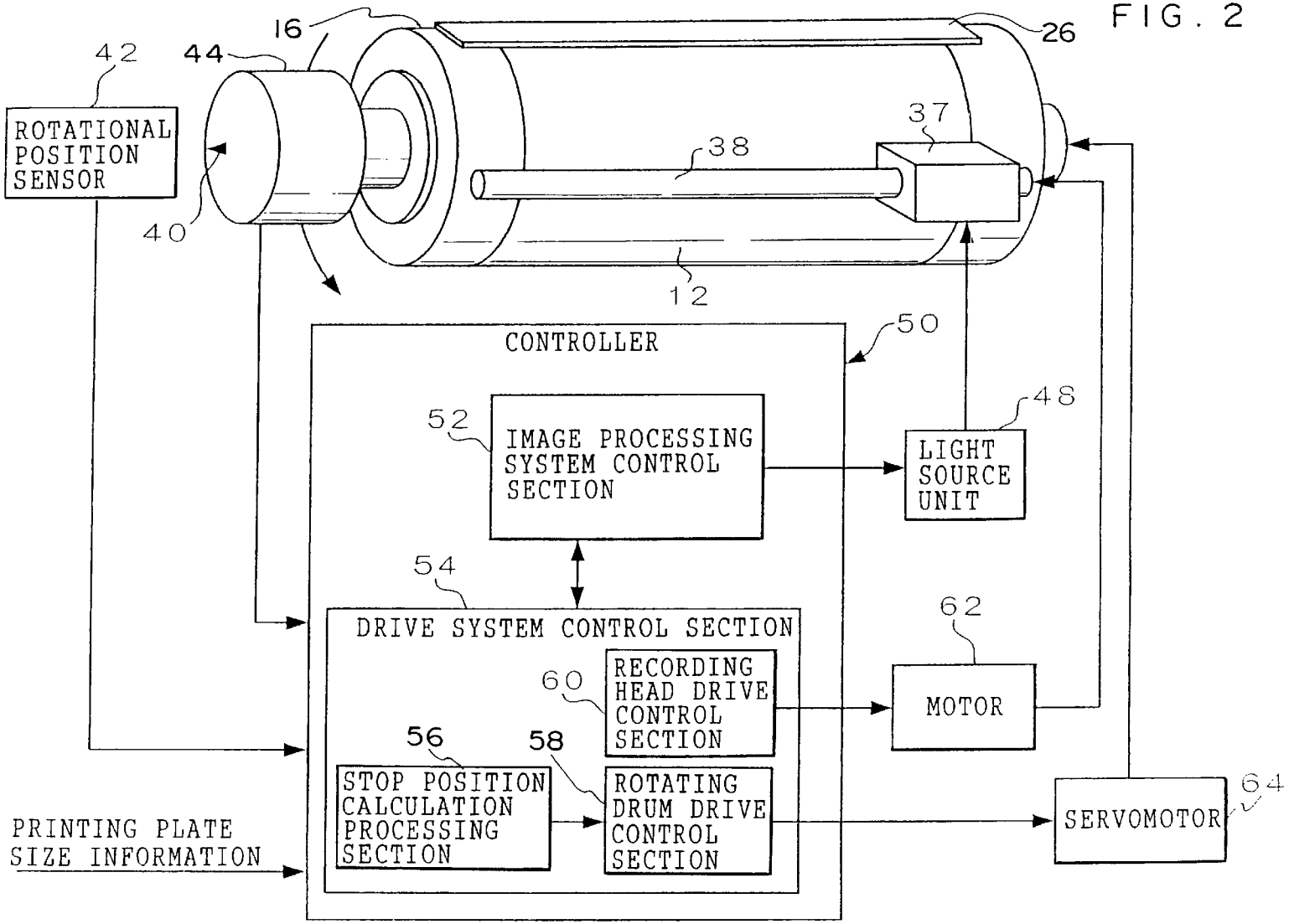
FIG. 2 is a block diagram illustrating the schematic structure of a controller for driving a rotating drum and a recording head.

FIG. 2 illustrates a control system for rotation of the rotating drum 16, movement of the recording head 37 and image recording of the recording head 37 on the basis of image signals.

A controller 50 which controls the whole device is structured so as to include an image processing system control section 52 for controlling an image processing and sending of image data and a drive system control section 54 for controlling operations of the respective sections.

The rotating drum 16 is rotated by a driving force from a servomotor 64. A rotational speed of the servomotor 64 is controlled on the basis of driving pulses from a rotating drum drive control section 58 of the drive system control section 54.

A rotary encoder 44 which is coaxial with the rotating drum 16 is provided at an axial direction one end portion of the shaft portion of the rotating drum 16. The rotary encoder 44 generates pulse signals according to a rotational speed of the rotating drum 16.

Such pulse signal serves as a basic pulse of timing for the image processing system control section 52 sending image data when the recording head 37 scans/exposes an image.

A mark is formed at an arbitrary position as a reference of rotation on the rotary encoder 44 that is in its peripheral direction with respect to the axis of the rotating drum 16 and serves as a rotational reference position 40. A rotational position sensor 42 for detecting the rotational reference position 40 is provided so as to oppose the rotating drum 16. The rotational position sensor 42 detects the rotational reference position 40 for every time the rotating drum 16 is rotated.

The recording head 37 is supported by a supporting shaft 38 and irradiates light input from light sources of a light source unit 48 with a plurality of light sources (LDs or the like) being placed therein as light beams. The recording head 37 is moved on the supporting shaft 38 in the axial direction of the rotating drum 16 by a driving force from a motor 62.

A recording head driving section 60 for driving the motor 62 controls a rotational speed of the motor 62 so that the recording head 37 is moved on the supporting shaft 38 according to a rotational speed of the rotating drum 16.

Thus, the recording head main body 37 is moved along the supporting shaft 38 (sub-scanning) according to rotation of the rotating drum 16 (main scanning), so that an image on the basis of image data is scanned/exposed on the printing plate 12.

At the exposure section 14, when scanning/exposure on the printing plate 12 is completed, the rotating drum 16 is stopped at a position that the trailing edge chuck 36 holding the trailing edge of the printing plate 12 opposes the trailing chuck detachment unit 32 (i.e., at a trailing edge chuck detaching position) and the trailing edge chuck 36 is removed from the rotating drum 16. The trailing edge of the printing plate 12 is released.

According to the present embodiment, the trailing edge chuck detaching position is varied depending on the length of the printing plate 12 rolled around the rotating drum 16 in a direction the printing plate 12 is rolled around. Thus, in order to reliably stop the rotating drum 16 at the trailing edge chuck detaching position, a stop position calculation processing section 56 for calculating the position that the rotating drum 16 is stopped is provided.

Figure 3:
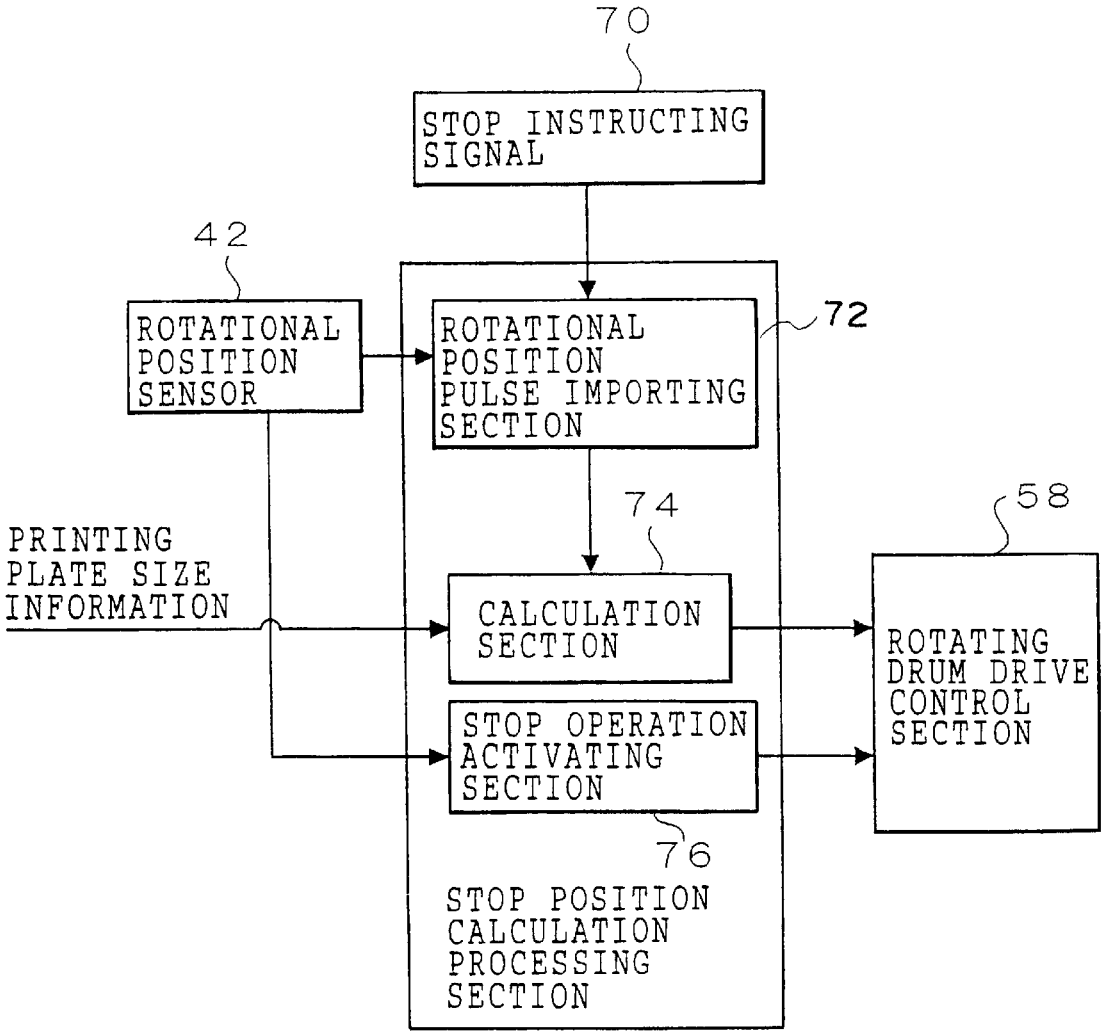
FIG. 3 is a block diagram illustrating the structure of a stop position calculation processing section.

The stop position calculation processing section 56 includes, as shown in FIG. 3, a rotational position pulse importing section 72 for importing pulse signals indicating detection of the rotational reference position 40 generated by the rotational position sensor 42, a calculation section 74 for calculating and generating stop control pulses and a stop operation activating section 76 for instructing an activation of a stop operation.

In the stop position calculation processing section 56, when a stop instructing signal 70 is input, the rotational position pulse importing section 72 imports a detected rotational position pulse from the rotational position sensor 42.

The calculation section 74 obtains a position of the trailing edge chuck 36 from printing plate size information by using a stop instructing signal and a rotational position pulse as triggers, and starts calculation of a stop control pulse for stopping the rotating drum 16 at a trailing edge chuck detaching position on the basis of the rotational reference position 40. A calculated stop control pulse is temporarily stored in the rotating drum drive control section 58.

When calculation of the stop control pulse ends, a detected rotational position pulse is imported from the rotational position sensor 42 to the stop operation activating section 76. The stop operation activating section 76 sends a stop operation activating signal for starting a stop operation to the rotating drum drive control section 58 when the rotational position sensor 42 detects the rotational reference position 40.

Operations of the present embodiment will be described hereinafter.

Firstly, the rotating drum 16 is stopped so that the leading edge chuck 26 is placed at the printing plate attaching position. The printing plate 12 is guided to oppose the puncher 24 by the feed plate guide 20. A positioning notch is formed at the leading edge of the printing plate 12. The printing plate 12 is temporarily returned to the feed plate guide 20.

The printing plate 12 is conveyed by the feed plate guide 20 in a tangential direction of the rotating drum 16 onto the peripheral surface of the rotating drum 16. The positioning notch of the printing plate 12 is abutted against a positioning pin so that the printing plate 12 is positioned. The leading edge of the printing plate 12 is nipped between the leading edge chuck 26 and the peripheral surface of the rotating drum 16 and held therebetween.

The rotating drum 16 is rotated and the printing plate 12 is rolled around the peripheral surface of the rotating drum 16. When the trailing edge of the printing plate 12 opposes the trailing edge chuck 36, the printing plate 12 is nipped and held by the trailing edge chuck 36. In this way, preparation for exposure is completed.

Image data is read and an exposure processing starts by light beams from the recording head portion 37. The exposure processing is a so-called scanning/exposure that the recording head portion 37 is moved in the axial direction of the rotating drum 16 while the rotating drum 16 being rotated at high speed (main scanning).

When the exposure processing ends, the controller 50 performs a processing for stopping rotation. The processing for stopping rotation performed by the controller 50 will be described hereinafter with reference to a time chart illustrated in FIG. 4.

Figure 4:
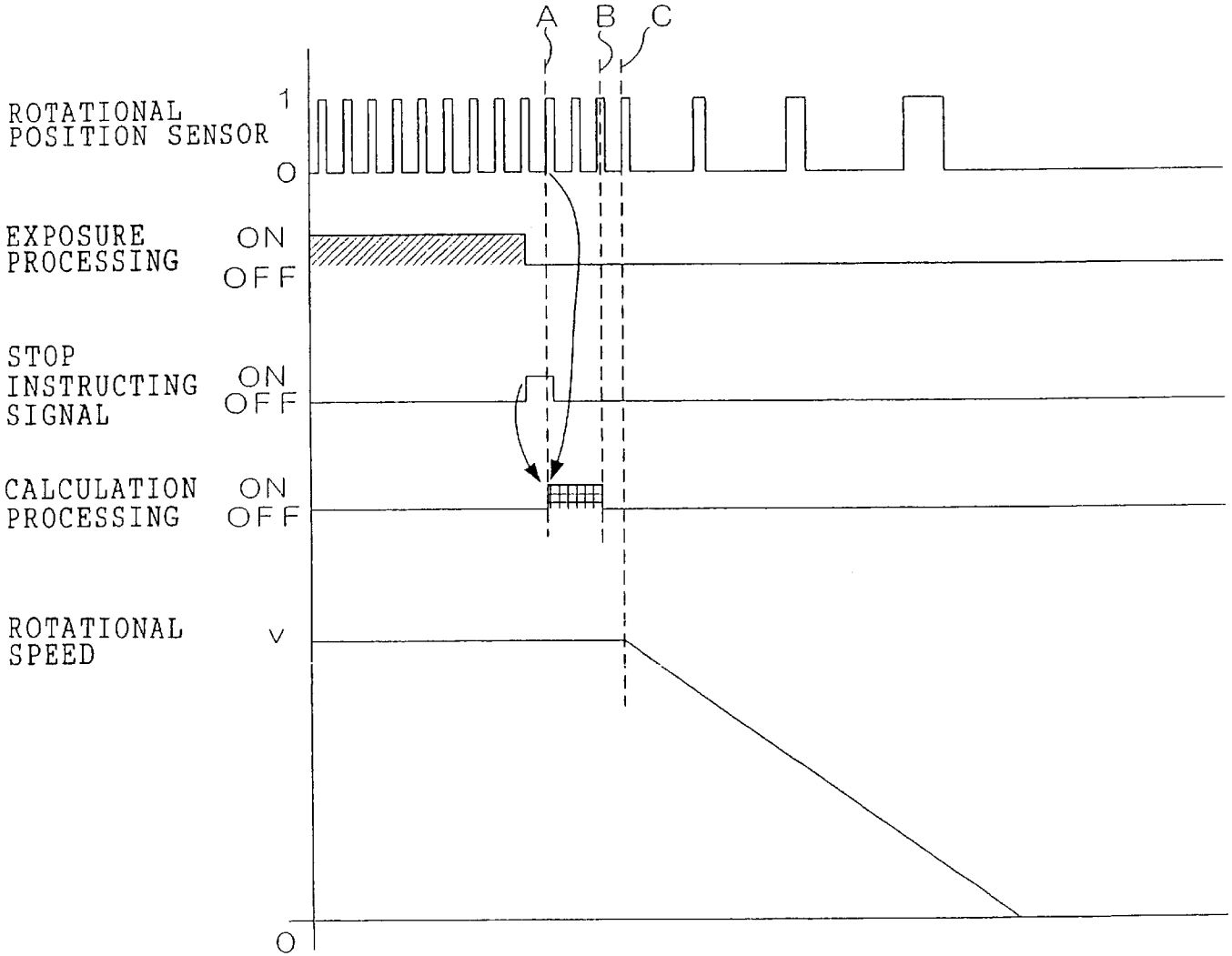
FIG. 4 is a time chart of a processing for stopping rotation performed by the controller according to a first embodiment.

Referring to FIG. 4, "rotational position sensor" indicates a state of a pulse detected by the rotational position sensor 42. The detected pulse indicates "1" when the rotational reference position 40 is detected and. "0" when the rotational reference position 40 is not detected. "Exposure processing" indicates a state that an exposure processing is being performed ("ON") or a state that the exposure processing is not performed ("OFF"). In "stop instructing signal", a state that a stop instructing signal is input is indicated by "ON" and a state that the stop instructing signal is not input is indicated by "OFF". "Calculation processing" indicates a state that a calculation processing is being performed ("ON") or a state that the calculation processing is not performed ("OFF") Rotational speed (v) indicates a rotational speed on the basis of rotational speed information from the rotary encoder 44.

When an exposure processing ends, the controller 50 inputs a signal for instructing stop of rotation to the stop position calculation processing section 56. A detected pulse of the rotational reference position 40 is imported from the rotational position sensor 42 to the rotational position pulse importing section 72 and a position of the trailing edge chuck 36 is obtained from printing plate size information. At the same time with detection of the rotational reference position 40 (see A shown in FIG. 4) the calculation section 74 calculates a stop control pulse so that the rotating drum 16 is stopped in the shortest time from when the rotational position sensor 42 detects the rotational reference position 40 to when the trailing edge chuck 36 reaches the trailing edge chuck detaching position opposing the trailing edge chuck detachment unit 32.

When the calculation ends (see B shown in FIG. 4), a stop control pulse is temporarily stored in the rotating drum drive control section 58. Further, a detected pulse of the rotational reference position 40 from the rotational position sensor 42 is imported to the stop operation activating section 76.

After the calculation ends, a stop operation activating signal is input in order to start a stop operation to the rotating drum drive control section 58 at a timing that the rotational position sensor 42 detects the rotational reference position 40 (see C shown in FIG. 4).

The rotating drum drive control section 58 drives the servomotor 66 according to a calculated stop control pulse so as to stop rotation of the rotating drum 16.

When the rotating drum 16 is stopped, the trailing edge chuck 36 is released by the trailing edge chuck detachment unit 32 and the conveyance guide unit 18 is switched (the discharge plate guide 22 corresponds to the rotating drum 16). Then, the rotating drum 16 is rotated in a direction the printing plate 12 is output. The printing plate 12 rolled around the rotating drum 16 is discharged from its trailing edge side in a tangential direction of the rotating drum. At this time, the printing plate 12 is fed to the discharge plate guide 22.

As described above, according to the automatic exposure device for printing plate according to this first embodiment, the rotational reference position 40 is detected by the rotational position detecting sensor 42 for every time the rotating drum 16 is rotated. Thus, a rotational position of the rotating drum 16 at a time of detection can be known. Subsequent to the signal for instructing stop of rotation 70 of the rotating drum 16 being input, the rotational reference position 40 of the rotating drum 16 is detected. The stop position calculation processing section 56 calculates a stop control pulse for stopping the rotating drum 16 from the rotational position to the trailing edge chuck detaching position, so that the rotating drum 16 can be precisely stopped at the trailing edge chuck detaching position. Further, when the rotational reference position 40 is detected after calculation, the rotating drum drive control section 58 performs a stop processing on the basis of the stop control pulse. Thus, the stop position is not shifted by the time required for calculation and generation of stop control pulse.

Consequently, a rotating drum rotating at high speed can be precisely and rapidly stopped at a predetermined position.

(Second Embodiment)

According to the first embodiment, there has been described the case in which subsequent to an exposure processing, a position that the rotating drum 16 is stopped is calculated by the stop position calculation processing section 56 and the rotating drum 16 is stopped according to the result of calculation. On the other hand, according to a second embodiment, the case that subsequent to an exposure processing, a rotational speed of the rotating drum 16 is decreased to a predetermined rotational speed, then the stop position calculation processing section 56 calculates a stop position of the rotating drum 16 and thus the rotating drum 16 is stopped according to the result of calculation will be described.

As the structure of an automatic exposure device for printing plate according to the present embodiment is the same as that of the exposure section 14 described in the first embodiment, same reference numerals are denoted to components thereof and their descriptions will be omitted.

When an exposure processing by the image processing system control section 52 ends, the controller 50 performs a processing for stopping rotation. The processing for stopping rotation performed by the controller 50 will be described hereinafter with reference to a time chart illustrated in FIG. 5.

Figure 5:
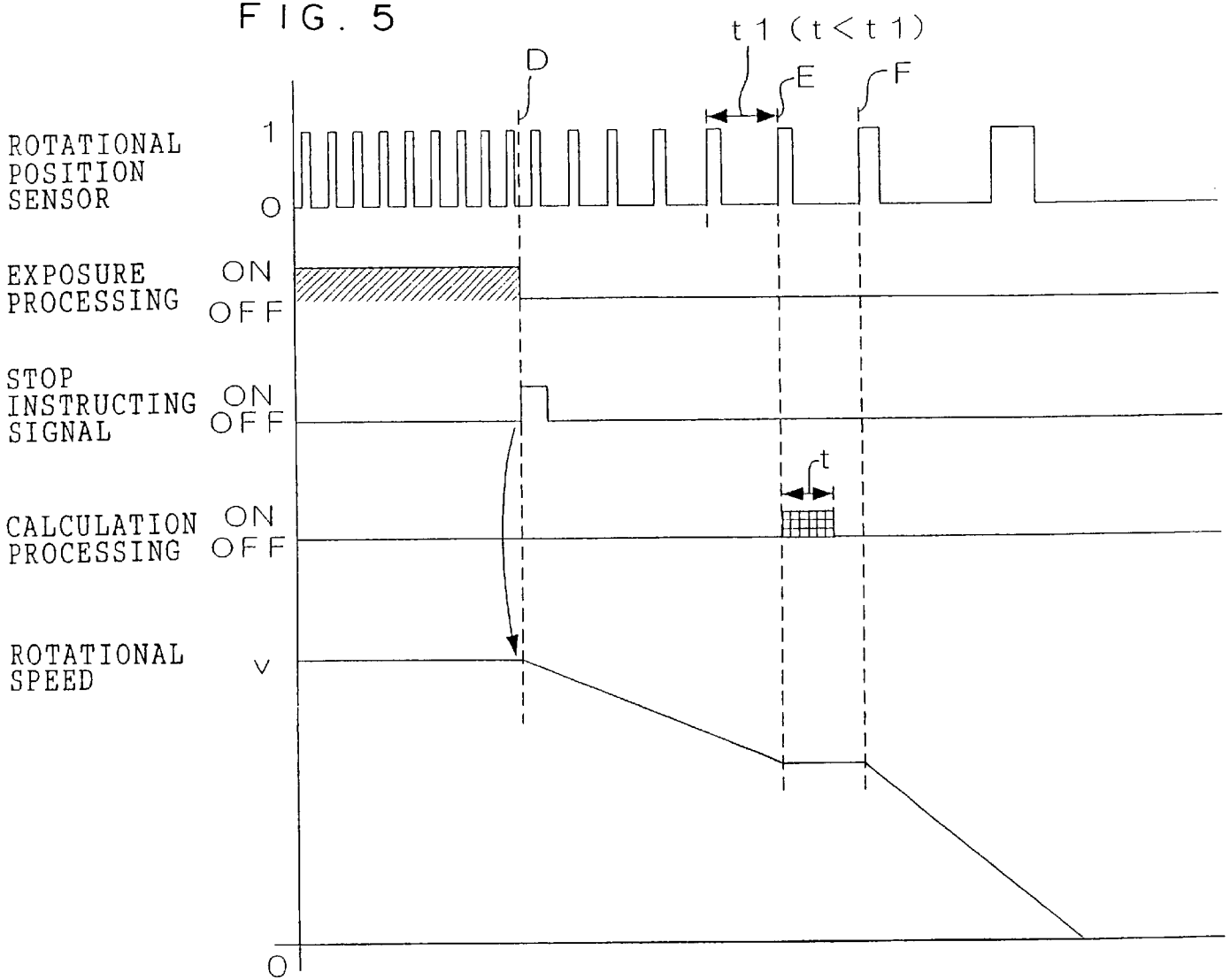
FIG. 5 is a time chart of a processing for stopping rotation performed by the controller according to a second embodiment.

Referring to FIG. 5, "rotational position sensor" indicates a state of a pulse detected by the rotational position sensor 42. The detected pulse indicates "1" when the rotational reference position 40 is detected and "0" when the rotational reference position 40 is not detected. "Exposure processing" indicates a state that an exposure processing is being performed ("ON") or a state that the exposure processing is not performed ("OFF"). In "stop instructing signal", a state that a stop instructing signal is input is indicated by "ON" and a state that the stop instructing signal is not input is indicated by "OFF". "Calculation processing" indicates a state that a calculation processing is being performed ("ON") or a state that the calculation processing is not performed ("OFF"). Rotational speed (v) indicates a rotational speed on the basis of rotational speed information from the rotary encoder 44.

When an exposure processing ends, the controller 50 inputs a stop instructing signal to the stop position calculation processing section 56 (see D shown in FIG. 5). The stop position calculation processing section 56 generates a control pulse for decreasing a rotational speed of the rotating drum 16. The rotational speed of the rotating drum 16 is decreased to a predetermined rotational speed by the rotating drum drive control section 58 through the servomotor 64.

Here, assume that an interval for the rotational position sensor 42 to detect the rotational reference position 40, i.e., a time required for the rotating drum 16 to be rotated for one time is indicated by t1 and a time required for the stop position calculation processing section 56 to calculate a stop control pulse is indicated by t. The relationship between t and t1 at a time of exposure processing is represented by $t>t1$.

The rotational speed of the rotating drum 16 is decreased and the time required for the rotating drum 16 to be rotated for one time becomes longer according to a decrease in rotational speed, so as to be $t<t1$. The rotational position pulse importing section 72 imports a detected pulse of the rotational reference position 40 from the rotational position sensor 42 (see E shown in FIG. 5). A decrease in rotational speed of the rotating drum 16 is temporarily stopped and the rotating drum 16 is rotated while maintaining a constant speed. The calculation section 74 obtains the rotational reference position 40, and a position of the trailing edge chuck 36 from printing plate size information, and calculates a stop control pulse for stopping the rotating drum 16 at the trailing edge chuck detaching position.

When the calculation at the calculation section 74 ends, the calculated stop control pulse is temporarily stored in the rotating drum drive control section 58. The stop operation activating section 76 imports a detected pulse of the rotational reference position 40 from the rotational position sensor 42, inputs a stop operation activating signal to the rotating drum drive control section 58 when the rotational reference position 40 is detected (see F shown in FIG. 5) and instructs to start a stop operation according to the result of calculation.

The rotating drum drive control section 58 drives the servomotor 64 on the basis of the stop control pulse and stops the rotating drum 16 at the trailing edge chuck detaching position.

As described above, according to the drive system control section 54 of this second embodiment, after a stop signal is input to the stop position calculation processing section 56 and before a calculation at the calculation section 74 starts, the rotational speed of the rotating drum 16 is decreased to a rotational speed that a calculation of stop control pulse at the calculation section 74 is completed during the rotating drum 16 being rotated for one time. At the same time when the next rotational reference position 40 is detected by the rotational position sensor 42, a stop control pulse is calculated by the calculation section 74 and the rotating drum 16 is stopped. The rotational speed of the rotating drum 16 is decreased immediately after a stop signal is input. Thus, the time required for a stop processing becomes shorter.

According to the first and second embodiments, a mark is provided as the rotational reference position 40 for obtaining the rotational position of the rotating drum 16 and is detected by the rotational position sensor 42. A light emitting element, a convex portion, or a concave portion may be provided and detected by the rotational position sensor 42.

According to the first and second embodiments, the rotational reference position 40 is detected by the rotational position sensor 42. Positional information may be obtained by a pulse signal from the rotary encoder 44. In this case, the rotational position sensor 42 may not be provided.

Figure 6:
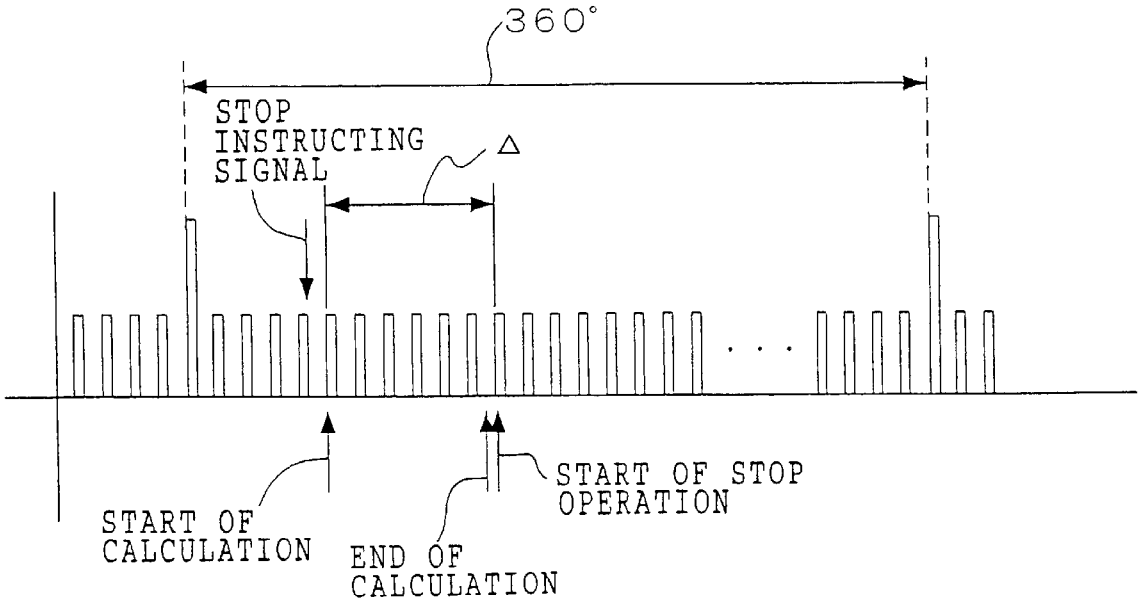
FIG. 6 is a time chart illustrating another embodiment of the processing for stopping rotation.

When all signals from the rotary encoder 44 which outputs a plurality of pulses in a rotation are used, as shown in FIG. 6, subsequent to the stop instructing signal 70 being input, the rotational position pulse importing section 72 imports a rotational position pulse from the rotational position sensor 42. The calculation section 74 starts the calculation of a stop control pulse when a rotational position is detected. After the calculation, the stop operation activating section 76 imports a rotational position pulse from the rotational position sensor 42. When a rotational position is detected, a stop operation activating signal for starting a stop operation is input to the rotating drum drive control section 58. Further, at the calculation section 74, a stop control pulse is corrected by a deviation of rotational angle of the rotating drum 16 between the time of start of calculation and the time of start of stop operation (see Δ shown in FIG. 6).

According to the first and the second embodiments, the rotational reference position 40 is placed at a position which is not related with the leading edge chuck 26 nor the trailing edge chuck 36. Nevertheless, the invention is not limited to this case and the rotational reference position may be, for example, at the same position as the leading edge chuck 26 or the trailing edge chuck 36. Thus, a calculation processing for a current position of the trailing edge chuck 36 becomes easy.

According to the first and the second embodiments, a stop control for a rotating drum has been described with the exposure section 14 of an automatic exposure device for printing plate used as an example. The device for controlling rotation of rotating drum according to the invention may be applied to devices using a rotating drum. Further, the invention may be applied to, in addition to a rotating drum for image recording, a rotational control for a plate cylinder for ink processing in which a printing plate is rolled around, inks are supplied thereto so that printing is performed upon a print sheet. Hereinafter a third embodiment will be described. According to the third embodiment, an example of applying the invention to a CTC (computer to cylinder) machine in which in a rotating drum for image recording, not a printing plate but a photosensitive film is successively rolled around a plate cylinder and image recording and supply of inks are performed will be described. Further, an example of applying the invention to a multi-color printing machine that has functions of automatically rolling a printing plate around its plate cylinder and of unwinding the same will be described as a fourth embodiment.

(Third Embodiment)

Figure 7:
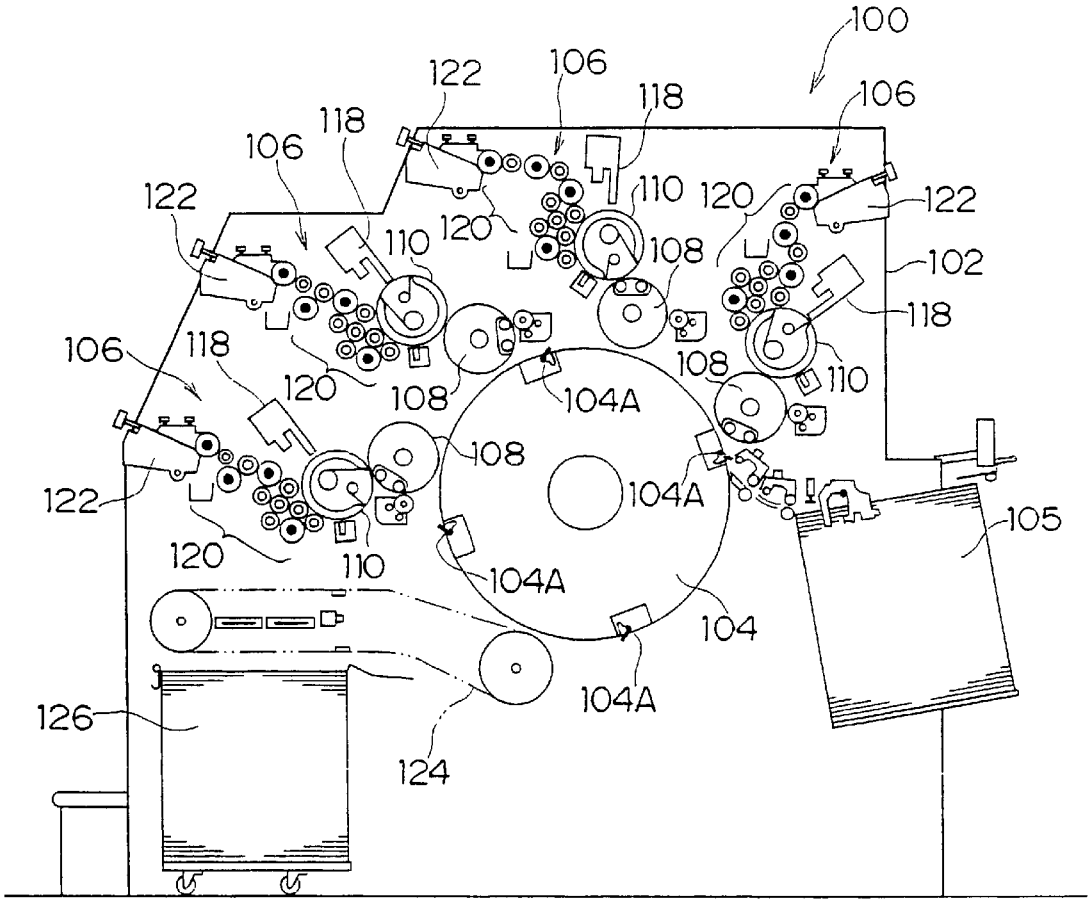
FIG. 7 is a schematic view of a CTC printing machine according to a third embodiment.

FIG. 7 illustrates the schematic structure of a CTC printing machine according to a third embodiment of the invention.

An impression cylinder 104 with a large diameter is disposed within a housing 102 so as to be at a central portion thereof.

Sheets are fed from a sheet feeding portion 105 to the impression cylinder 104 on a sheet-by-sheet basis and rolled around the peripheral surface of the impression cylinder 104. The impression cylinder 104 has a peripheral length which is four or more times as long as a conveyance direction length of a sheet and thus four sheets can be rolled around its peripheral surface at the same time. Conveyance direction leading and trailing edges of sheets are chucked by a plurality of chuck portions 104A and thus the sheets are set in close contact with the peripheral surface of the impression cylinder 104.

Four print units 106 are provided around the impression cylinder 104. The print units 106 serve as supplying images of Y (yellow), M (magenta), C (cyan) and K (black) colors to the impression cylinder 104.

Each of the print units 106 includes a blanket cylinder 108 which contacts the impression cylinder 104 (sheets) and a plate cylinder 110 which transfers color images to the blanket cylinder 108.

The plate cylinder 110 can move so as to approach or away from the blanket cylinder 108.

Figure 8:
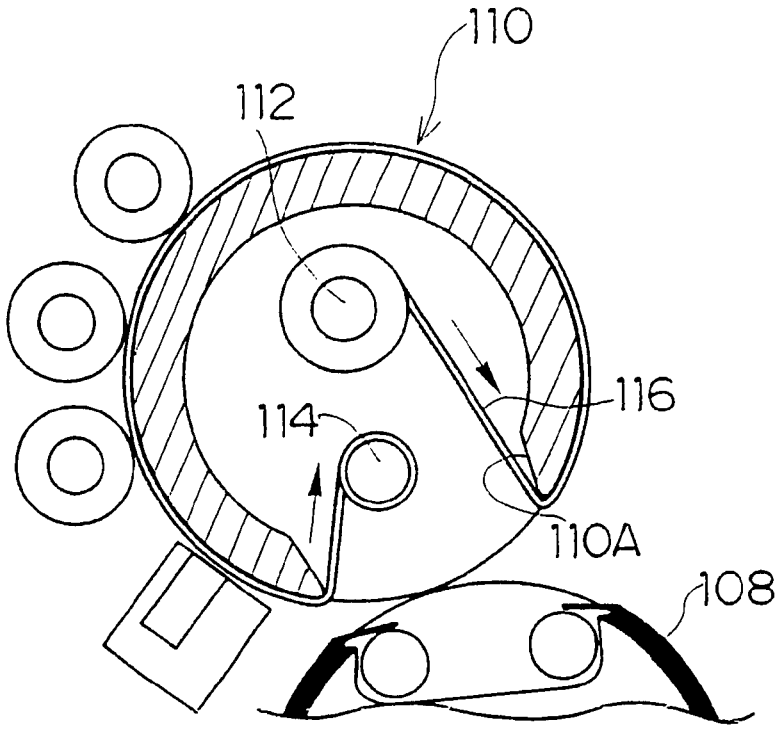
FIG. 8 is an enlarged view of a plate cylinder of a CTC printing machine according to a third embodiment.

As shown in FIG. 8, the plate cylinder 110 is hollow. Rotational shafts 112 and 114 are placed at positions that are eccentric from a center of rotational axis of the plate cylinder 110. An unexposed photosensitive film 116 is rolled around one rotational shaft 112 in a layered manner.

The photosensitive film 116 drawn from the one rotational shaft 112 exits from a through-hole 110A which communicates the inside of the plate cylinder 110 with the outside thereof, is rolled around the peripheral surface of the plate cylinder 110 for one time, enters again through the through-hole 110A and is taken up by the other rotational shaft 114.

The rotational shafts 112 and 114 are rotated so as to feed the photosensitive film 116 in a fixed direction on the basis of the length thereof rolled around the outer peripheral surface of the plate cylinder 110.

As illustrated in FIG. 7, an exposure head 118 is disposed so as to oppose the peripheral surface of the plate cylinder 110. While the unexposed photosensitive film 116 is rolled around the outer peripheral surface of the plate cylinder 110, the exposure head 118 irradiates light according to image signals. At the same time, the plate cylinder 110 is rotated at high speed (while being set apart from the blanket cylinder 108). In this way, an image is recorded in the photosensitive film 116.

The plate cylinder 110 subjected to image recording is stopped at a predetermined position and moved to contact the blanket cylinder 108 in synchronous with conveyance of sheets rolled around the impression cylinder 104.

Each of color inks is supplied from each ink tank 122 via a group of rollers 120 to the plate cylinder 110. An ink is supplied onto either of an image recording area and a non-image recording area (depending on a positive type or a negative type) of the photosensitive film 116 rolled around the plate cylinder 110 and transferred onto a sheet rolled around the impression cylinder 104 through the blanket cylinder 108.

Inks are superimposed with each other and transferred by the four print units 106, so that a color print is obtained.

The sheet subjected to color printing is peeled from the impression cylinder 104 by a belt conveyor 124, conveyed to a sheet receiving portion 126 along the belt conveyor 124 and collected therein.

When a printed image is to be changed, the rotational shafts 112 and 114 inside the plate cylinder 110 are rotated, so that the exposed photosensitive film 116 is removed (taken up onto the rotational shaft 114) and the unexposed photosensitive film 116 is rolled around the outer peripheral surface of the plate cylinder 110 (drawn from the rotational shaft 112). Consequently, an operation for attaching printing plates to the plate cylinder 110 or detaching the same therefrom is not required, resulting in an improvement in efficiency of print operation.

When an image is to be recorded in the unexposed photosensitive film 116 in the CTC printing machine 100 with the above-described structure, the plate cylinder 110 is rotated at a high speed and then stopped after image recording with an end of the image (its leading edge or trailing edge) being positioned at a predetermined position. Then, the plate cylinder 110 starts to contact the blanket cylinder 108.

At this time, as the position of the trailing edge of an image is varied depending on an image area, a stop position must be calculated according to information of a recorded image. The position of the leading edge of an image must be also calculated for every time according to a relative position of the image with a sheet.

Rapid stop of the plate cylinder 100 rotating at a high speed is required. A delay of control due to a calculation causes a color shift.

By applying the invention to a control for stopping the plate cylinder 100 rotating at a high speed, rapid stop control can be performed with high precision.

(Fourth Embodiment)

Figure 9:
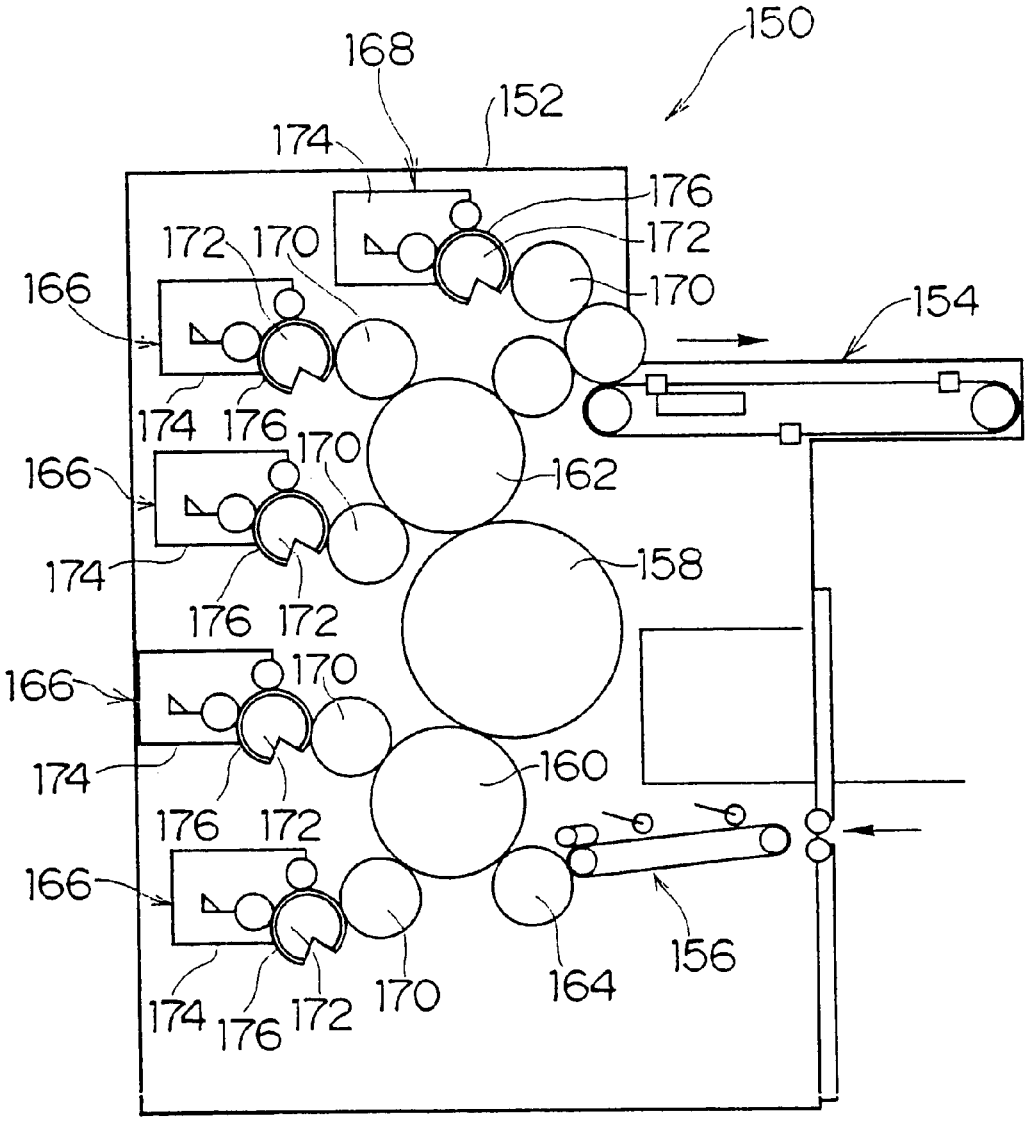
FIG. 9 is a schematic view of multi-color printing machine according to a fourth embodiment.

FIG. 9 illustrates the schematic structure of a multi-color printing machine 150 according to a fourth embodiment of the invention.

Two stages 154 and 156 are vertically provided within a housing 152. Sheets are usually fed from the lower stage 156.

A fed sheet is supplied onto the peripheral surface of a lower impression cylinder 160 of a pair of impression cylinders 160 and 162 rotating at a same linear speed with a transfer cylinder 158 being interposed therebetween.

The sheet is advanced onto the peripheral surface of the lower impression cylinder 160 from its tangential direction and nipped between the peripheral surface thereof and a feed cylinder 164 so as to be rolled around the lower impression cylinder 160 over half periphery thereof.

When the sheet is rolled around the lower impression cylinder 160 over its half periphery, it conveyed to the upper impression cylinder 162 via the transfer cylinder 158.

The sheet is advanced to the upper impression cylinder 162 from its tangential direction, nipped between the upper impression cylinder 162 and the transfer cylinder 158 and rolled around the upper impression cylinder 162 over its half periphery.

When the sheet is rolled around the upper impression cylinder 162 over its half periphery, the sheet is discharged outside the housing 152 from the upper stage 154.

Two print units 166 are respectively disposed so as to oppose areas of the sheet rolled around the impression cylinders 160 and 162 over their half peripheries.

The print units 166 place color images (Y, M, C and K) on the basis of the same image upon the sheet and print the color images thereon. By the sheet being moved while rolled around the impression cylinders 160 and 162, the colors are successively superimposed and thus multi-color printing is performed.

An additional print unit 168 for printing additional images different from Y, M, C and K images (e.g., characteristics, characters, stamps and the like) in a superimposed manner or for coating an uppermost layer of a multi-color image is disposed at the upper impression cylinder 162. When including the additional print unit 168, 4+1 (=5) print units 166 and 168 in total have the same structure and thus only one of them (the lowermost print unit 166 shown in FIG. 9) will be described and structural descriptions of other units will be omitted.

The print unit 166 is formed by a blanket cylinder 170 contacting the impression cylinder 160, a plate cylinder 172 contacting the blanket cylinder 170 and an ink applying device 174. A printing plate 176 is rolled around the plate cylinder 172. An ink supplied from the ink applying device 174 is applied onto an image area or a non-image area (depending on a positive type or a negative type) and printed onto a sheet rolled around the impression cylinder 160 and conveyed via the blanket cylinder 170.

According to the above-described multi-color printing machine 150, the plate cylinder 172 around which the printing plate 176 is rolled is in synchronous with a position of a sheet rolled around the impression cylinder 160. Thus, multi-colored printed images can be placed upon the sheet without misalignment and then printed.

In order to perform a print processing rapidly, successively fed sheets must be positioned while the plate cylinder 172 around which the printing plate 176 is rolled being rotated at a high speed.

By applying the invention to a control for stopping the plate cylinder 172 rotating at a high speed, a stop control can be performed rapidly with high precision.

When an image is changed, the printing plate 176 must be exchanged. Then, the printing plate 176 may be supplied from the lower stage 156 and automatically rolled around the plate cylinder 172. In an operation for exchanging the printing plate 176, the invention may be applied to a control for stopping the plate cylinder at a position that the leading edge (or the trailing edge) of the printing plate is rolled.

Figure 10A:
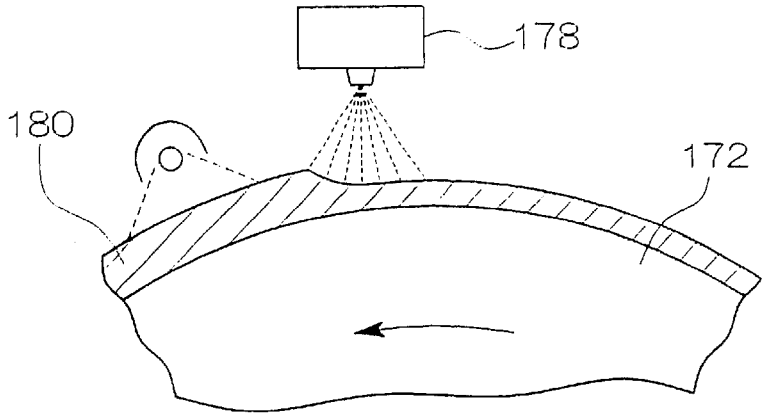
FIG. 10A illustrates a coating process.
Figure 10B:
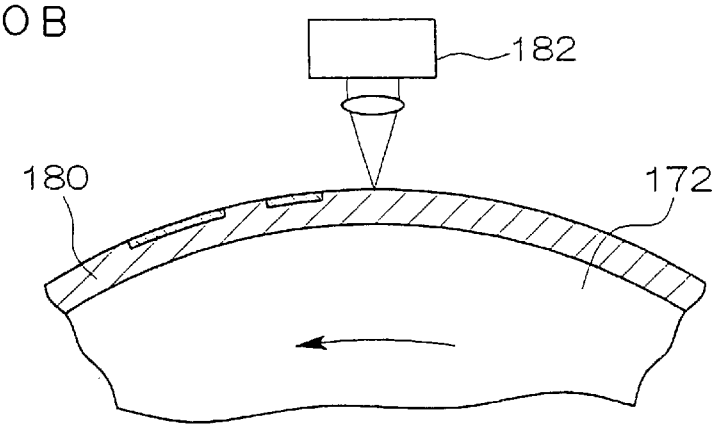
FIG. 10B illustrates exposure process.
Figure 10C:
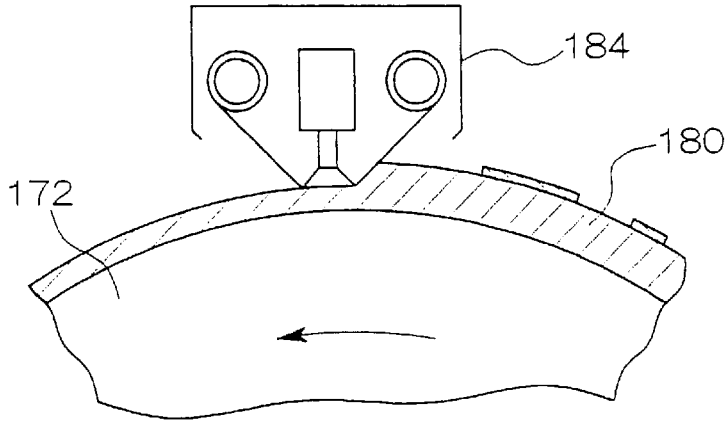
FIG. 10C illustrates coating removal process.

According to the multi-color printing machine 150, the printing plate 176 is rolled around the plate cylinder 172. Alternatively, a CTC direct input type plate cylinder 172 may be applied. As shown in FIG. 10A, a photosensitive film layer 180 is coated onto the peripheral surface of the plate cylinder 172 by a coating spray 178. As shown in FIG. 10B, an image is formed by a recording head 182. When printing of the image is completed, as shown in FIG. 10C, the film layer with the image being formed thereon is removed by a coating removal device 184. Then, a new photosensitive film layer 180 is coated by the coating spray 182.

As described above, according to the invention, it is possible to obtain an excellent effect of being capable of stopping a rotating drum rotating at high speed at a predetermined position with high precision in a device for controlling rotation of rotating drum that is used for an image recording device in which a recording head is moved over the peripheral surface of the rotating drum rotating at high speed with a sheet of recording material being rolled around in its axial direction so as to record an image thereon and that controls rotation and stop of the rotating drum.

What is claimed is:

1. A device for controlling rotation of a rotating drum, the device comprising:

a rotational position detection unit for detecting a rotational position of the rotating drum at least for each rotation thereof;

a stop control pulse generation unit for calculating a stop control pulse on the basis of a first rotational position of the rotating drum and generating the same, which first rotational position has been detected by the rotational position detection unit after a stop signal for instructing stopping of rotation of the rotating drum is input and;

a correction unit for correcting the stop control pulse on the basis of a positional deviation between the first rotational position detected at the time of commencing generation of the stop control pulse and a second rotational position of the rotating drum detected after the stop control pulse has been generated and;

a control unit for controlling stopping of the drum on the basis of the corrected stop control pulse corrected by the correction unit.

2. A device for controlling rotation of a rotating drum according to claim 1, wherein:

one pulse is output during one rotation of the rotating drum; and after the stop signal is input, the rotational position detection unit detects the first rotational position, the stop control pulse generation unit starts to calculate and generate the stop control pulse, the second rotational position is detected after generation of the stop control pulse, and then the rotating drum is stopped by the control unit, so that a correction by the correction unit is offset.

3. A device for controlling rotation of a rotating drum according to claim 1, wherein:

the control unit starts to decrease a rotational speed of the rotating drum after the stop signal is input and before the stop control pulse generation unit starts to calculate, stops decreasing the rotational speed of the rotating drum at a time when calculation and generation of the stop control pulse during one rotation of the rotating drum become possible, and detects a first rotational position.

4. A device for controlling rotation of a rotating drum according to claim 1, wherein:

a plurality of pulses are output during one rotation of the rotating drum; and after the stop signal is input, the rotational position detection unit detects the first rotational position, the stop control pulse generation unit starts to calculate and generate the stop control pulse, the rotational position detection unit detects the second rotational position after generation of the stop control pulse, and the correction unit corrects the stop control pulse by a difference of rotational angle between the first rotational position and the second rotational position.

5. A device for controlling rotation of a rotating drum that is used in an image recording device in which an image is recorded on a sheet of recording material that is rolled around a peripheral surface of the rotating drum, the device comprising:

a rotational position detection unit for detecting a rotational position of the rotating drum at least for each rotation thereof;

stop control pulse generation unit for detecting a first rotational position of the rotating drum after a stop signal for instructing stopping of rotation of the rotating drum is input and for calculating a stop control pulse on the basis of the first rotational position and generating the same;

a correction unit for detecting a second rotational position of the rotating drum after the stop control pulse has been generated and for correcting the stop control pulse on the basis of a positional deviation between the second rotational position and the first rotational position detected at the time of commencing generation of the stop control pulse; and a control unit for controlling stopping of the drum on the basis of the corrected stop control pulse by the correction unit.

6. A device for controlling rotation of a rotating drum according to claim 5, wherein:

one pulse is output during one rotation of the rotating drum; and after the stop signal is input, the rotational position detection unit detects the first rotational position, the stop control pulse generation unit starts to calculate and generate the stop control pulse, the second rotational position is detected after generation of the stop control pulse, and then the rotating drum is stopped by the control unit, so that a correction by the correction unit is offset.

7. A device for controlling rotation of a rotating drum according to claim 5, wherein:

the control unit starts to decrease a rotational speed of the rotating drum after the stop signal is input and before the stop control pulse generation unit starts to calculate, stops decreasing the rotational speed of the rotating drum at a time when calculation and generation of the stop control pulse during one rotation of the rotating drum become possible, and detects a first rotational position.

8. A device for controlling rotation of a rotating drum according to claim 5, wherein:

a plurality of pulses are output during one rotation of the rotating drum; and after the stop signal is input, the rotational position detection unit detects the first rotational position, the stop control pulse generation unit starts to calculate and generate the stop control pulse, the rotational position detection unit detects the second rotational position after generation of the stop control pulse, and the correction unit corrects the stop control pulse by a difference of rotational angle between the first rotational position and the second rotational position.

9. A device for controlling rotation of a rotating drum that is used in an image recording device in which a recording head records an image on a sheet of recording material by moving in an axial direction of the rotating drum as the rotating drum rotates with the sheet of recording material being rolled around a peripheral surface thereof, the device comprising:

a rotational position detection unit for detecting a rotational position of the rotating drum at least for each rotation thereof;

a stop control pulse generation unit for detecting a first rotational position of the rotating drum after a stop signal for instructing stopping of rotation of the rotating drum is input, and for calculating a stop control pulse on the basis of the first rotational position and generating the same;

a correction unit for detecting a second rotational position of the rotating drum after the stop control pulse has been generated and for correcting the stop control pulse on the basis of a positional deviation between the second rotational position and the first rotational position detected at the time of commencing generation of the stop control pulse; and a control unit for controlling stopping of the drum on the basis of the corrected stop control pulse corrected by the correction unit.

10. A device for controlling rotation of a rotating drum according to claim 9, wherein:

one pulse is output during one rotation of the rotating drum; and after the stop signal is input, the rotational position detection unit detects the first rotational position, the stop control pulse generation unit starts to calculate and generate the stop control pulse, the second rotational position is detected after generation of the stop control pulse, and then the rotating drum is stopped by the control unit, so that a correction by the correction unit is offset.

11. A device for controlling rotation of a rotating drum according to claim 9, wherein:

the control unit starts to decrease a rotational speed of the rotating drum after the stop signal is input and before the stop control pulse generation unit starts to calculate, stops decreasing the rotational speed of the rotating drum at a time when calculation and generation of the stop control pulse during one rotation of the rotating drum become possible, and detects a first rotational position.

12. A device for controlling rotation of a rotating drum according to claim 9, wherein:

a plurality of pulses are output during one rotation of the rotating drum; and after the stop signal is input, the rotational position detection unit detects the first rotational position, the stop control pulse generation unit starts to calculate and generate the stop control pulse, the rotational position detection unit detects the second rotational position after generation of the stop control pulse, and the correction unit corrects the stop control pulse by a difference of rotational angle between the first rotational position and the second rotational position.

* * * * *